US005289233A

United States Patent [19]

Sakamoto et al.

[11] Patent Number: 5,289,233

[45] Date of Patent: Feb. 22, 1994

[54] REMOVABLY MOUNTABLE IMAGE FORMING UNIT HELD TOGETHER BY THERMALLY SHRINKABLE FILM

[75] Inventors: Masashi Sakamoto, Toyohashi; Shin Miyata, Toyokawa, both of Japan

[73] Assignee: Minolta Camera Kabushiki Kaisha, Osaka, Japan

[21] Appl. No.: 826,864

[22] Filed: Jan. 28, 1992

[30] Foreign Application Priority Data

Jan. 31, 1991 [JP] Japan ..... 3-10654
Dec. 3, 1991 [JP] Japan ..... 3-319020

[51] Int. Cl.[5] ..... G03G 15/00
[52] U.S. Cl. ..... 355/200; 355/211
[58] Field of Search ..... 355/200, 210, 211, 245; 174/DIG. 8, 52.3; 206/497

[56] References Cited

U.S. PATENT DOCUMENTS 4,223,177 9/1980 Nakamura ..... 174/DIG. 8
4,551,000 11/1985 Kanemitsu et al. ..... 355/210
4,575,221 3/1986 Onoda et al. ..... 355/200
4,591,258 5/1986 Nishino et al. ..... 355/200
4,601,259 7/1986 Yamashita ..... 355/253 X
4,803,512 2/1989 Ogura et al. ..... 355/219
4,984,018 1/1991 Andou et al. ..... 355/200
5,079,668 1/1992 Maeshima ..... 355/255
5,105,221 4/1992 Takahashi et al. ..... 355/210

*Primary Examiner*—A. T. Grimley
*Assistant Examiner*—Robert Beatty
*Attorney, Agent, or Firm*—Willian Brinks Hofer Gilson & Lione

[57] ABSTRACT

An image forming unit removably mountable in an image forming apparatus is composed of a plurality of image forming elements including at least a photosensitive drum. The unit is assembled by providing a pair of side plates with the image forming elements between, and covering the outside of the side plates with a thermally shrinkable resin film to firmly connect the image forming elements with the side plates.

23 Claims, 13 Drawing Sheets

REMOVABLY MOUNTABLE IMAGE FORMING UNIT HELD TOGETHER BY THERMALLY SHRINKABLE FILM

BACKGROUND OF THE INVENTION

1. Field of the Invention

The present invention relates to an image forming unit removably mountable in image forming apparatus such as electrophotographic copying machines and laser beam printers.

2. Description of the Related Art

In image forming apparatus, for example, in electrophotographic copying machines, a process unit is already known which comprises image forming elements, such as a photosensitive drum, developing device and cleaner, are supported in the form of an assembly by a common support body and which is removably mounted in the body of the machine. With the image forming apparatus of the type mentioned, the process unit is removed from the body of the apparatus and replaced by a new process unit when one of the image forming elements, i.e., the components of the unit, has run down.

When such a conventional process unit is assembled, the components of the unit are firmly connected to the support body in the form of an assemby, for example, with an adhesive or by ultrasonic bonding so as to permit the process unit to retain its own strength and to prevent spillage of toner from the unit.

With the conventional process unit, therefore, the components which have not served their life at the time of replacement are also replaced at the same time to result in economical losses.

Nevertheless, if it is attempted to disassemble the process unit for the reuse of the components which need not be replaced, the unit is difficult to disassemble since the components are inseparably connected or joined together firmly, while if the unit is forcibly disassembled, there arises the problem that the support body or some components are broken and become no longer reusable.

SUMMARY OF THE INVENTION

The main object of the present invention is to provide an image forming unit which comprises a plurality of components and which can be disassembled into the components with ease without breaking the components and the support body therefor.

Another object of the present invention is to provide an image forming unit having firmly joined portions and having a protected outer surface.

To fulfill these objects, the present invention provides an image forming unit removably mountable in the body of an image forming apparatus and comprising a plurality of components which are separably joined together and covered with a resin material.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

An embodiment of the invention will be described with reference to the drawings concerned.

Figure 1:
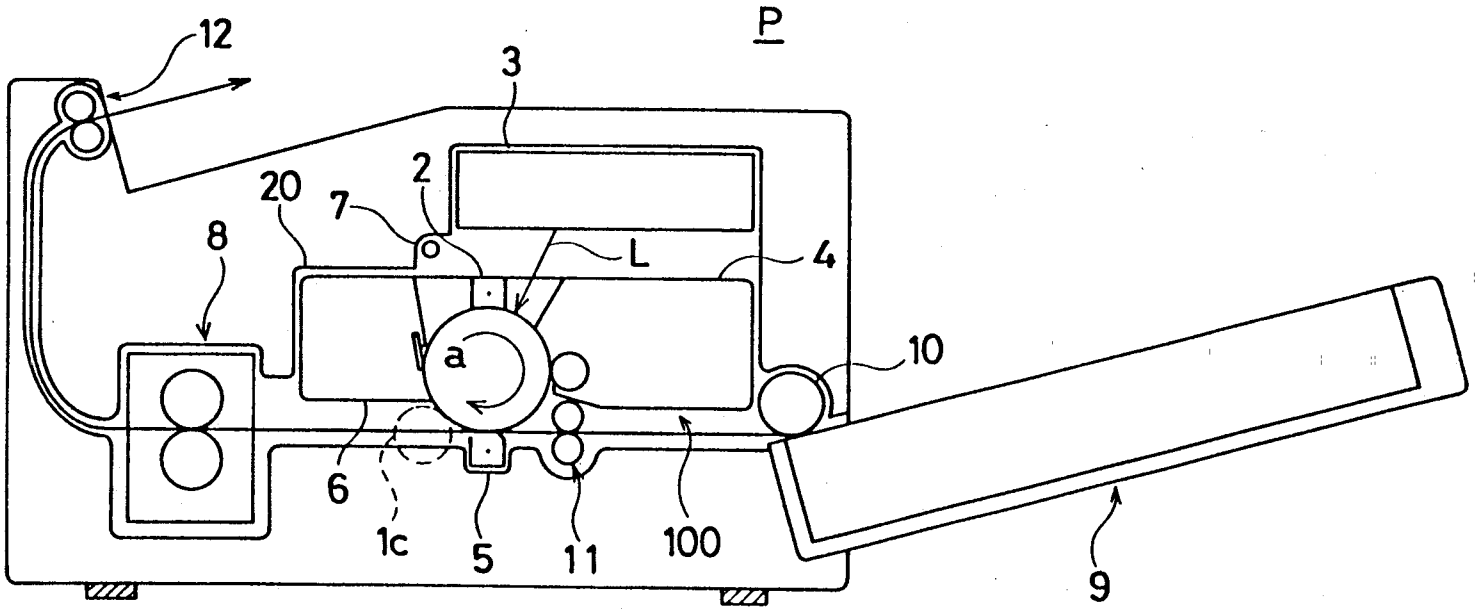
FIG. 1 is a side elevation in section of a laser beam printer equipped with an image forming unit embodying the invention.

FIG. 1 is a side elevation in section of a laser beam printer equipped with a process unit, i.e., an image forming unit embodying the invention. A photosensitive drum 1 having a photosensitive layer over the surface is supported approximately in the central portion of the body P of the printer and is rotatable in the direction of arrow a shown. Arranged around the drum 1 are a sensitizing charger 2 of the corona discharge type, laser optical system 3 for emitting a laser beam, developing device 4 containing toner, transfer charger 5, blade cleaner 6 and eraser lamp 7 for emitting eraser light.

As will be described later, the drum 1, sensitizing charger 2, developing device 4 and cleaner 6 are arranged together between and supported by a pair of side plates providing a support body, whereby a process unit 100 is formed. The process unit 100 is removably installed in a unit accommodating chamber 20 provided in the printer body P.

The laser optical system 3 includes a light source for emitting a semiconductor laser light, a collimator lens for forming the laser light from the light source into a bundle of parallel rays (beam), a polygonal mirror or like deflection means rotatable by a motor at a specified speed for deflecting the beam, and a lens assembly for converging the beam on the photosensitive drum 1 for scanning.

With the start of printing operation, the photosensitive drum 1 is uniformly charged by the sensitizing charger 2 while being rotated in the direction of arrow a, and is exposed to the laser beam L from the laser optical system 3, whereby an electrostatic latent image is formed on the drum surface. The latent image is developed by the developing device 4.

On the other hand, copy paper is sent out by a feed roller 10 from a paper cassette 9 disposed on the right side of the printer body P as illustrated. The paper is temporarily halted at the upstream side of a pair of timing rollers 11 and is thereafter fed to a transfer station between the drum 1 and the transfer charger 5, as timed with the image formed on the surface of the drum 1. Subsequently, the toner image is transferred onto the copy paper by the transfer charger 5 and fixed to the paper by a fixing device 8. The paper is then delivered from the printer body P by a pair of discharge rollers 12.

Figure 2:
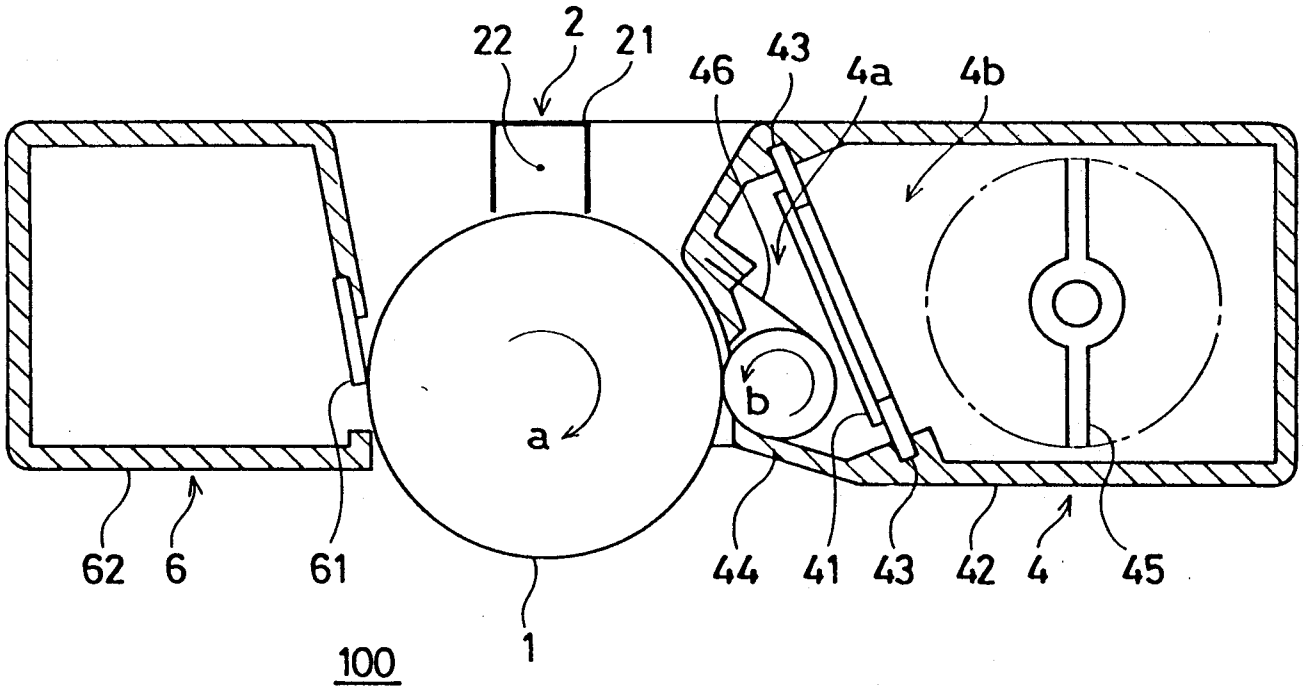
FIG. 2 is a sectional view of the image forming unit.

FIG. 2 is a side elevation showing the process unit 100 in section. With reference to this drawing, the components of the process unit 100, i.e., the photosensitive drum 1, sensitizing charger 2, developing device 4 and cleaner 6, will be described.

The developing device 4 is internally divided into a developing portion 4*a* and a toner compartment 4*b* by a partition 41. The partition 41 serves to hold the toner only in the toner compartment 4*b* before the process unit 100 is used, and is slidably fitted in slide grooves 43, 43 formed in a developing device housing 42 longitudinally thereof so as to be removable when the unit 100 is to be used. A sleeve roller 44 is supported within the developing portion 4*a* and is rotatable in the direction of arrow b shown for depositing the toner on the surface of the drum 1. A regulating plate 46 is pressed against the surface of the roller 44 for regulating the thickness of the toner layer.

The cleaner 6 comprises a blade 61 fixed to a cleaner housing 62 so as to be in pressing contact with the drum 1. The toner remaining on the surface of the drum 1 after the transfer is scraped off the drum surface 1 by the blade 61 and collected in the cleaner housing 62.

The sensitizing charger 2 comprises a shield plate 21 and a charge wire 22 extending inside the shield plate 21. A voltage of specified polarity is applied to the wire 22.

The photosensitive drum 1, sensitizing charger 2, developing device 4 and cleaner thus constructed are separably joined to the pair of side plates to be described later to form the process unit 100. The entire outer surface of the process unit 100 is covered with a resin film.

Figure 3:
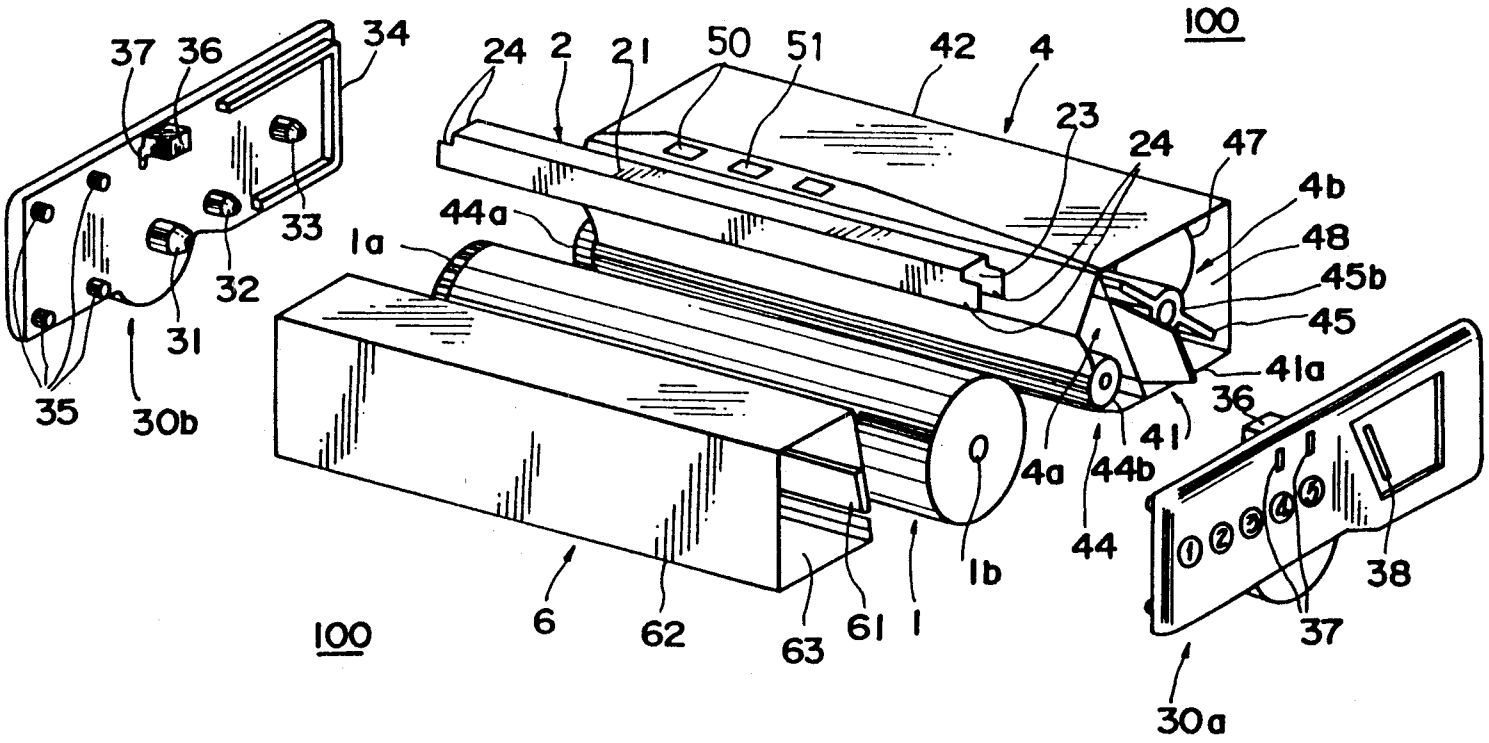
FIGS. 3 and 4 are perspective views of the image forming unit as disassembled.
Figure 4:
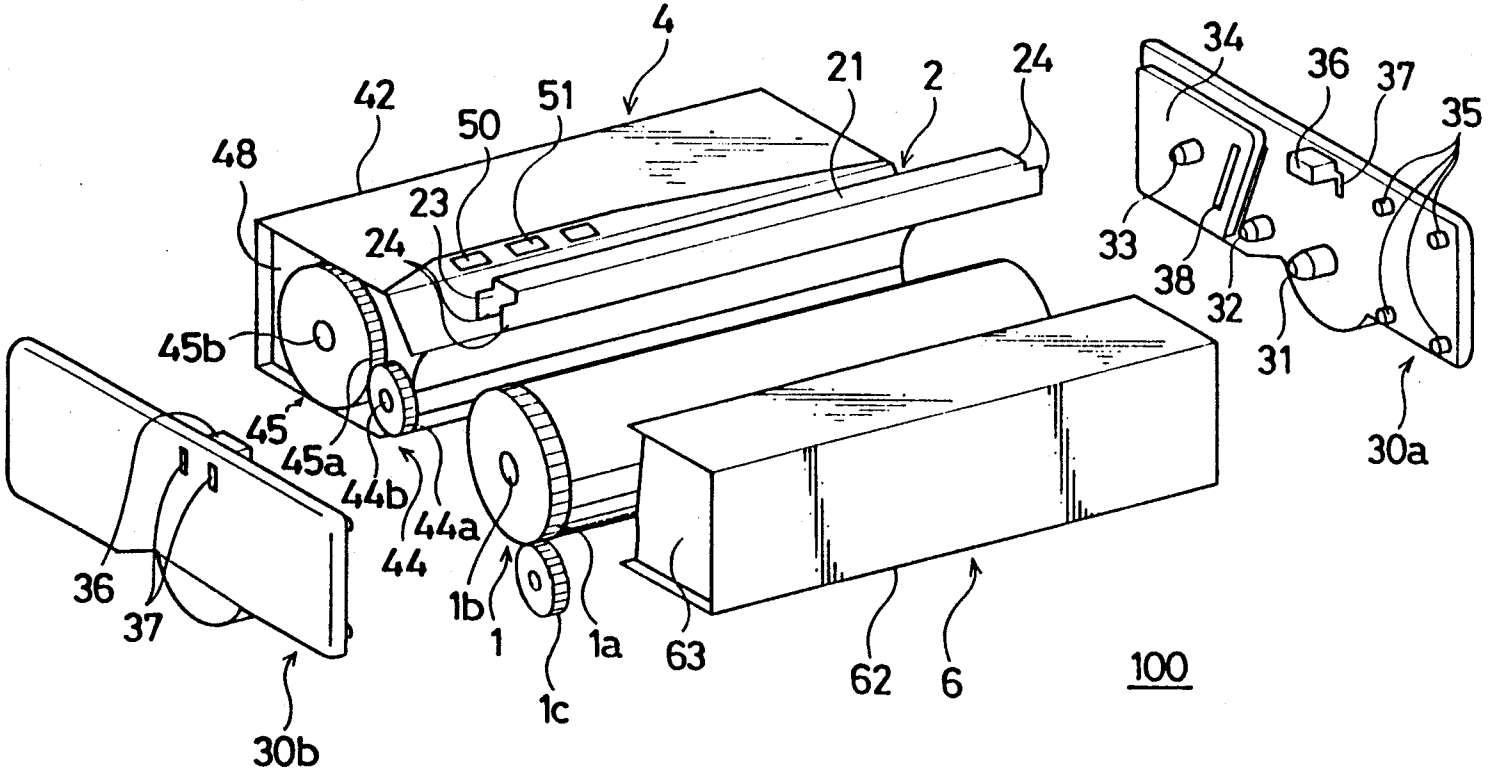
Figure 5:
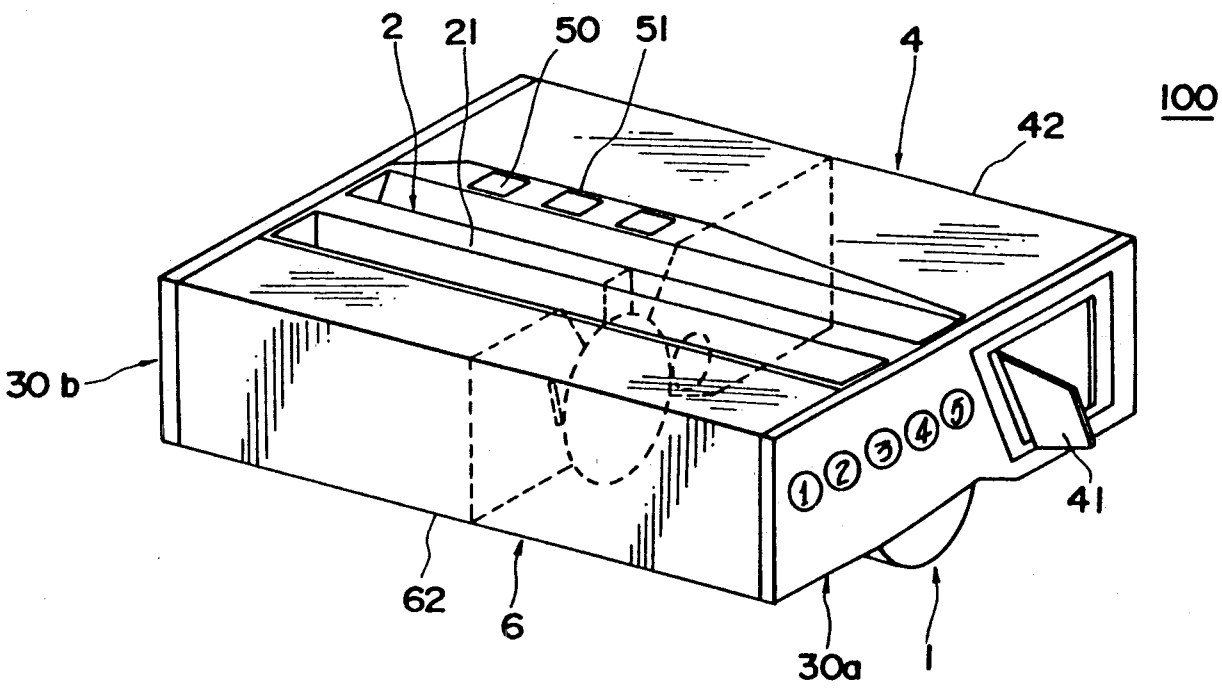
FIGS. 5 and 6 are perspective views showing the appearance of the image forming unit as assembled.
Figure 6:
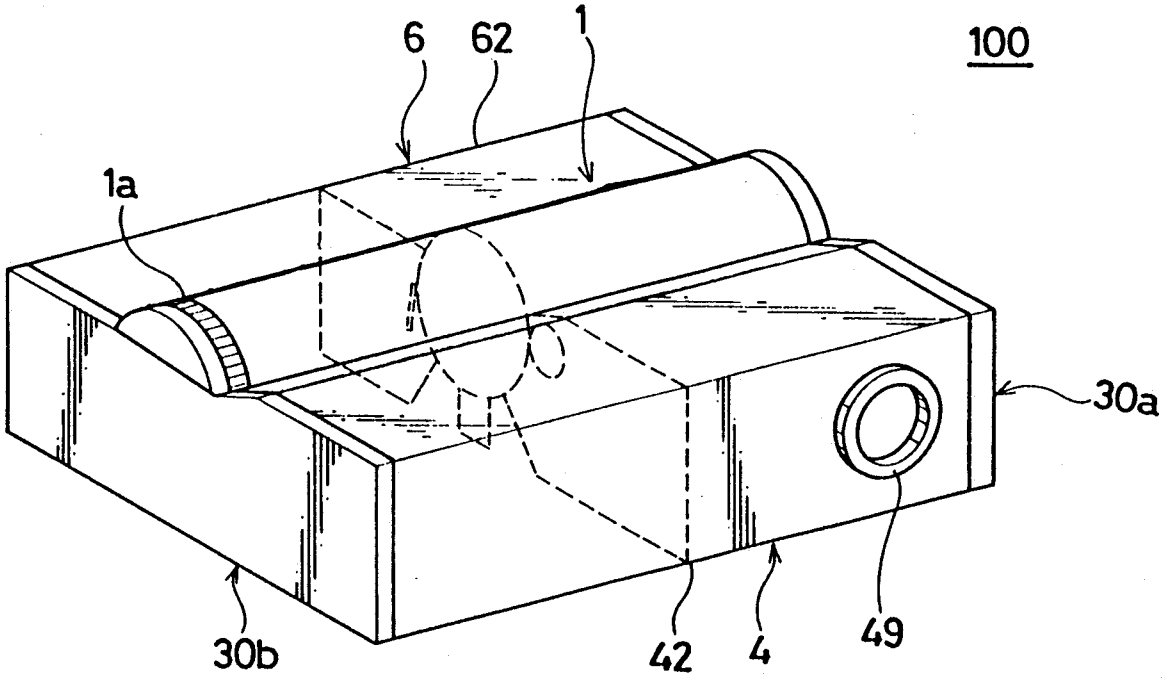

How to assemble the process unit 100 will be described next with reference to FIGS. 3 to 6. FIG. 3 is an exploded perspective view of the process unit 100 as it is seen from one side thereof closer to the person who is to install the unit into the printer body, and FIG. 4 is an exploded perspective view of the unit as it is seen from the remote side. Further FIGS. 5 and 6 are perspective views showing the appearance of the process unit 100 as assembled.

The components of the process unit 100 to be attached to the side plates, indicated at 30*a*, 30*b*, are prepared in the state to be described below. First, the sleeve roller 44 having a gear 44*a* attached to its remote end is inserted into the developing portion 4*a* within the developing device housing 42, and a toner agitating impeller 45 similarly carrying a gear 45*a* at its remote end is inserted into the toner compartment 4*b* to prepare the developing device 4 for assembling. The partition 41 is prepared as fitted in the slide grooves 43, 43 in the device housing 42. The housing 42 has a side plate formed with a toner replenishing opening 47, through which the developing device 4 is replenished with the toner. The developing unit housing 42 is provided on its top with connectors 50, 51, through which voltage is applied to the charge wire 22 of the charger 2 and the sleeve roller 44 of the developing device 4 from the printer body P.

The cleaner 6 is prepared with the blade 61 fixed to the cleaner housing 62. The sensitizing charger 2 is prepared with the charge wire 22 provided inside the shield plate 21. Further the drum 1 is prepared as positioned between the developing device 4 and the cleaner 6, with a gear 1*a* attached to the remote end of the drum.

The side plates 30*a*, 30*b* for supporting these components of the unit as an assembly are molded of resin. These side plates are each integrally formed on the inner side thereof with bosses 31, 32, 33 for rotatably supporting the drum 1, the sleeve roller 44 and the toner agitating impeller 45, respectively, and with a boss 34 and bosses 35 for fixedly supporting the developing device 4 and the cleaner 6, respectively. Each side plate further has a boss 36 and insertion holes 37 for supporting the sensitizing charger 2. The boss 34 on the side plate 30*a* has a partition slit 38. When the process unit 100 is to be used, the partition 41 is withdrawn from the housing 42 longitudinally thereof through the slit 38. The numerals (1), (2), (3), (4) and (5) are provided on the outer surface of the side plate 30*a*. These numerals (1) to (5) serve the function to be described below.

The procedure for assembling the process unit 100 will be described next. First, each boss 31 is fitted into an axial cavity 1*b* of the drum 1, each boss 32 into an axial cavity 44*b* of the sleeve roller 44, and each boss 33 into an axial cavity 45*b* of the impeller 45, whereby the drum 1, the sleeve roller 44 and the impeller 45 are positioned between and rotatably supported by the side plates 30*a*, 30*b*. The bosses 31, 32 and 33 are so positioned relative to one another that the gears 1*a*, 44*a* and 45*a* for driving these components will be assured of proper meshing engagement, with the surface of the drum 1 opposed to the surface of the sleeve roller 44 as spaced apart therefrom by a predetermined distance. Each boss 34 is pressed into an opening 48 of the developing device housing 42 utilizing the elasticity of the boss 34. As a result, the developing device 4 and the cleaner 6 are fixedly positioned between the side plates 30*a*, 30*b*. Furthermore, the bosses 36 are fitted into openings 23 at the respective ends of the charger 2, and inserting portions 24 at opposite ends of the shield plate 21 are fitted into the insertion holes 37, whereby the charger 2 is also fixedly positioned between the side plates 30*a*, 30*b*.

In this way, the components are assembled as supported by the side plates 30*a*, 30*b* in the form of a unit as seen in FIGS. 5 and 6. To make the process unit 100 easy to disassemble, the components are joined to the side plates 30*a*, 30*b* only by fitting. However, to permit the joints to retain strength, an adhesive may be used in combination with fitting. When to be used, the adhesive is used in such an amount (e.g. small amount) that the joined portions to which the adhesive is applied will not break when the unit 100 is disassembled. Alternatively, seal members (e.g., seal members of polyurethane foam) may be used in place of the adhesive. When the components are joined to the side plates 30*a*, 30*b* with use of seal members, it is possible to give strength to the joints and also to prevent the toner from spilling through the joints.

The process unit 100 is covered with a resin film by the method to be described next with reference to FIGS. 7 and 8.

The process unit 100 obtained by joining the components to the side plates 30*a*, 30*b* in the form of an assembly is externally covered with the resin film entirely.

The resin film covering the process unit 100 serves to prevent the toner from spilling through the joints between the component, such as the developing device 4 or the cleaner 6, and the side plates 30*a*, 30*b* and to join the components to the side plates 30*a*, 30*b* more effectively. Additionally, the unit 100 can be protected from defacement.

The resin film for use in the present embodiment is a thermally shrinkable material such as a polyvinyl chloride film ("HISHIREX," product of Mitsubishi Plastics Industries Ltd.) having a thickness of 15 to 20 micrometers. The thermally shrinkable resin film, which imparts an enhanced tensile strength upon shrinking, gives an increased strength to the joints between the components of the process unit 100 and the side plates 30*a*, 30*b* supporting the components in the form of an assembly.

Figure 7:
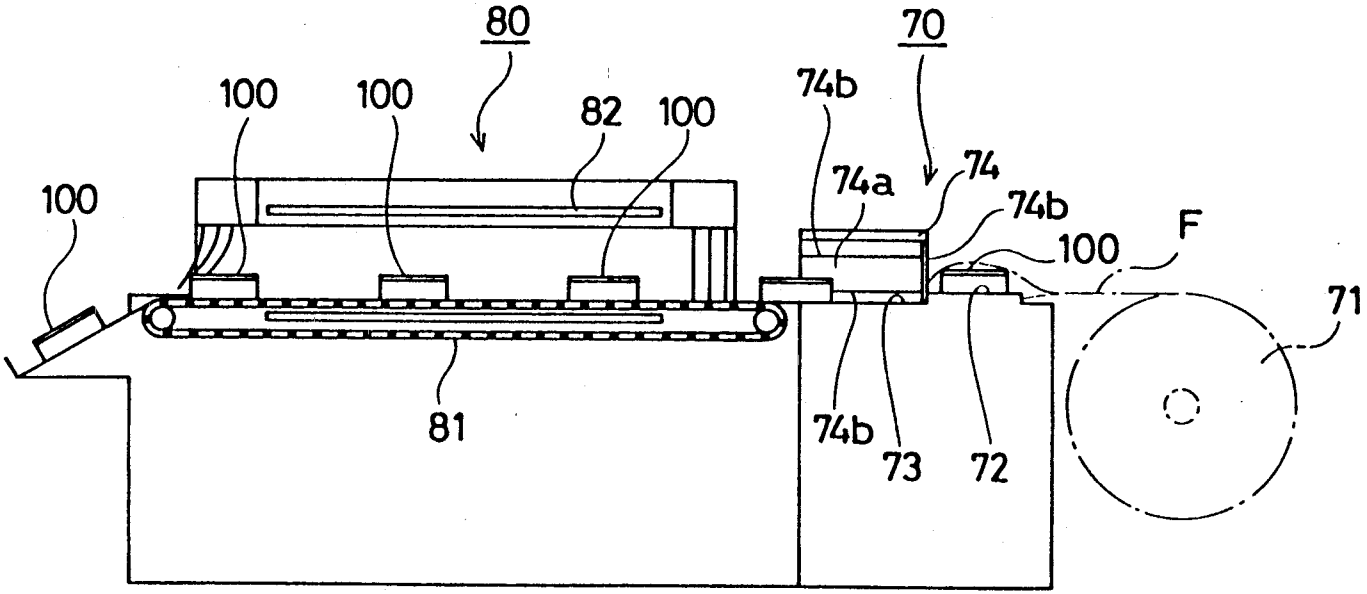
FIG. 7 is a side elevation in section of a packaging system (packaging apparatus and heating apparatus) for packaging the image forming unit with a resin film.
Figure 8:
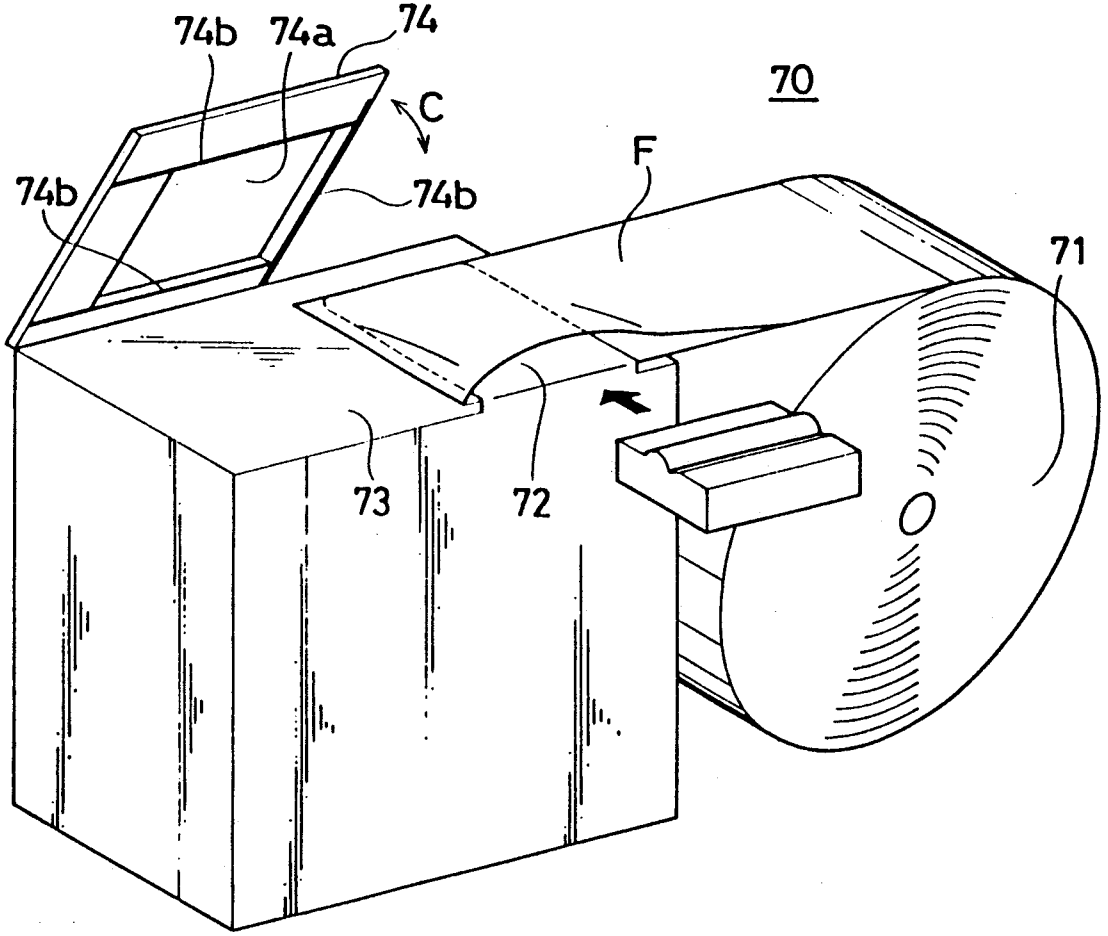
FIG. 8 is a perspective view showing the appearance of the apparatus for packaging the image forming unit with the resin film.

The process unit 100 is covered with the resin film by a packaging system shown in FIGS. 7 and 8. FIG. 7 is a side elevation in section showing the packaging system in its entirety. The system comprises a packaging apparatus 70 and a heating apparatus 80. FIG. 8 is a perspective view showing the appearance of the packaging apparatus 70 only.

The packaging apparatus 70 has a roll 70 of resin film F which is rotatable. The leading end of the resin film F paid off from the roll 71 is fused to the left end of a unit support table 72 in advance. A packaging table 73 has pivoted thereto a movable plate 74 having an opening 74*a* and movable in the direction of arrow c (see FIG. 8). Heating portions 74*b* comprising a heating wire are provided on the inner edge of the movable plate 74 defining the opening 74*a*.

When the packaging system is to be used for covering the process unit 100 with the film, the unit 100 is first inserted into a space between the support table 72 and the resin film F and then moved toward the packaging table 73, whereby the unit 100 is wrapped with the film F as folded in two and is placed on the table 73 in this state. Next, the movable plate 74 is moved down toward the operator to thereby contact the heating portions 74*b* with the resin film F, whereby edge portions of the film F in the form of a bag are fused together. In this way, the entire outer surface of the process unit 100 is covered with the resin film F. The heating portions 74*b* package the unit 100, sever the resin film F and fuse the resulting leading end of the film F extending from the roll 71 to the left end of the unit support table 72 in preparation for packaging the next unit.

Figure 9:
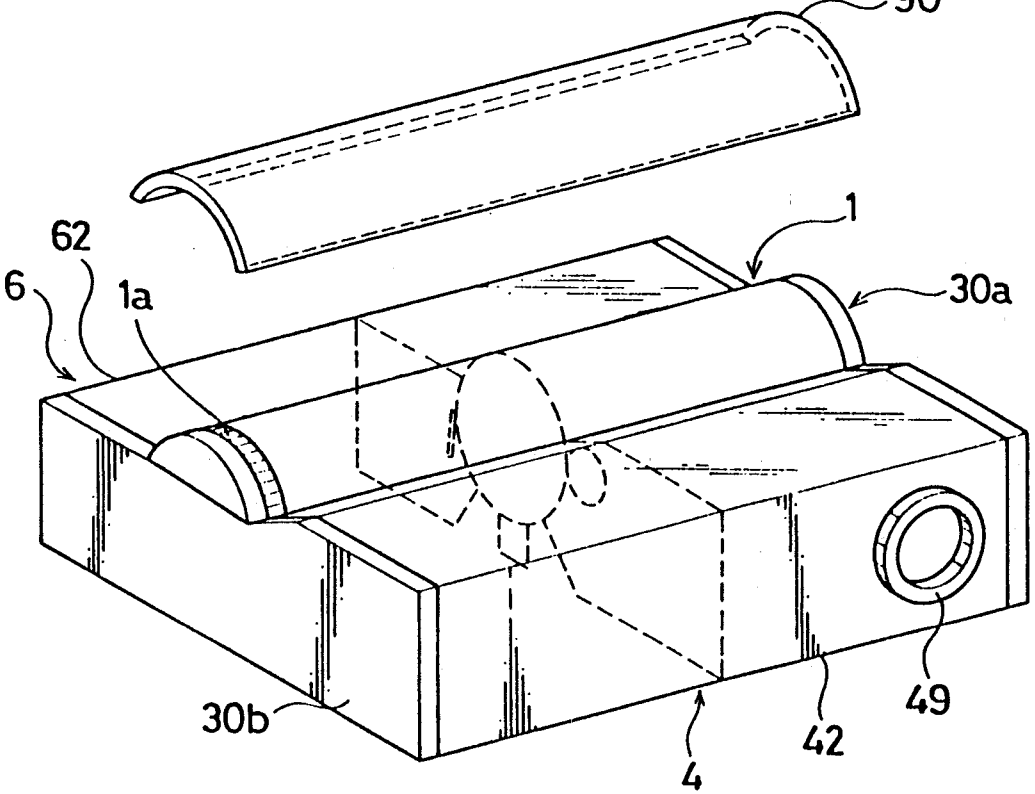
FIG. 9 is a perspective view showing how a photosensitive drum is to be covered with a heat-insulating material before the image forming unit is packaged with the resin film.

The process unit 100 covered with the resin film F by the packaging apparatus is sent to the heating apparatus 80 shown in FIG. 7 for heating. The heating apparatus 80 includes a conveyor belt 81 for transporting process units 100, and a heater 82 for heating the process unit 100 covered with the resin film F. When the film-covered process unit 100 is sent forward by the conveyor belt 81 and heated by the heater 81, the film F gradually shrinks to seal off the process unit 100 in its entirety in conformity with the shape thereof. With the present embodiment, the unit 100 is heated at 140° C. for 3 seconds. To render the photosensitive drum 1 free of the influence of heat in the above covering step, the drum 1 is covered with a heat-insulating material 90 as shown in FIG. 9 before the unit 100 is placed on the packaging apparatus 70.

Figure 10:
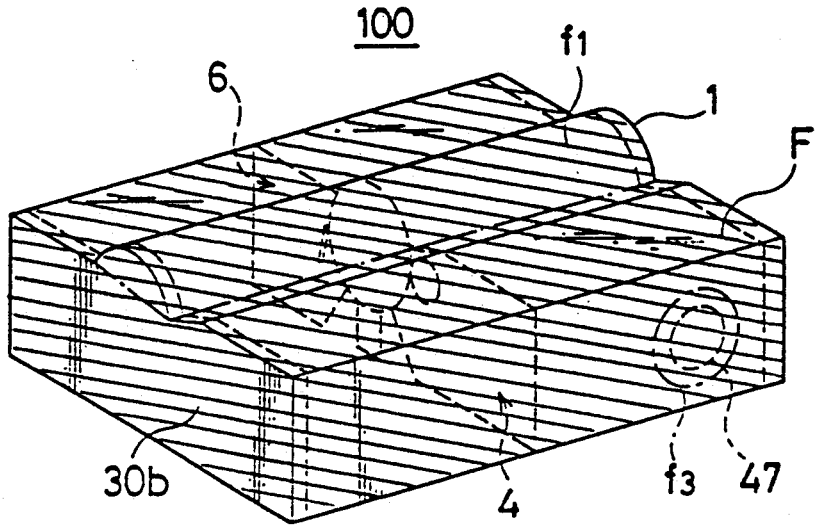
FIGS. 10 and 11 are perspective views of the image forming unit packaged with the resin film as perforated.
Figure 11:
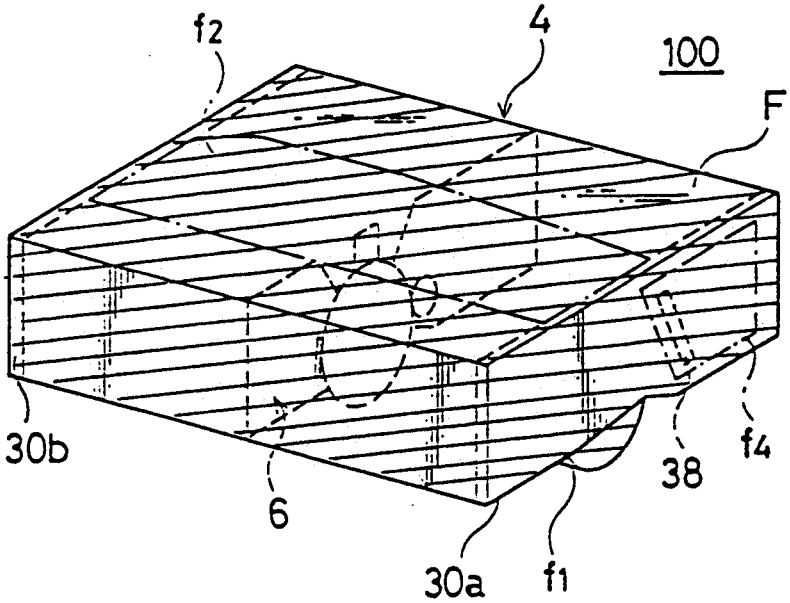

The resin film F covering the process unit 100 as described above is perforated in the final step of the packaging operation so as to be locally openable with ease at portions thereof corresponding to the unit portions cooperative with the printer body for forming images, to the toner replenishing opening 47 and to the partition slit 38. Stated more specifically with reference to FIGS. 10 and 11, the resin film F (shown by hatching) is perforated (indicated in dot-and-dash lines in the illustration) so as to be locally removable at a portion f1 corresponding to the unit portion where the drum 1 is to be opposed to the transfer charger 5, at a portion f2 corresponding to the unit portion where the laser beam from the laser optical system 3 and the eraser light from the eraser lamp 7 are to be incident on the drum 1, at a portion f3 opposed to the toner replenishing opening 47 and and at a portion f4 around the partition slit 38.

Figure 12:
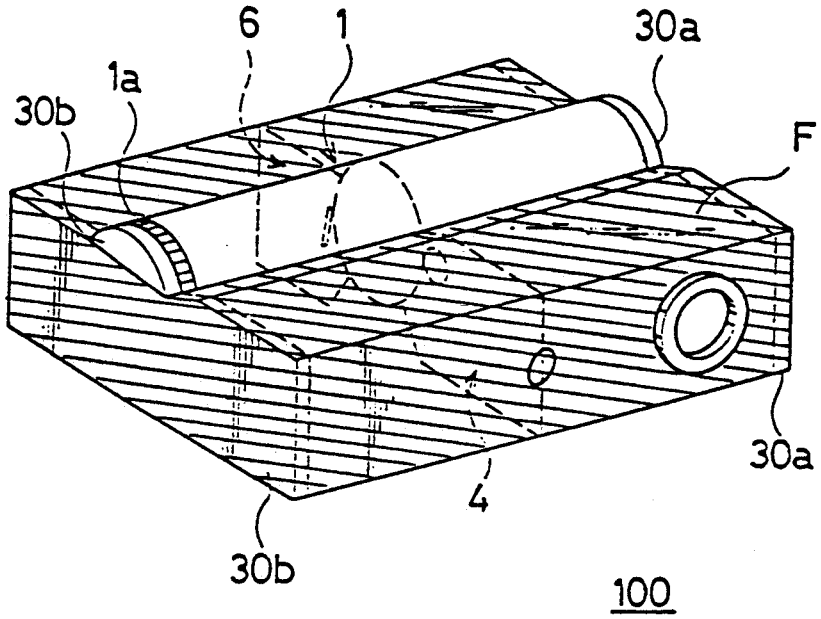
FIGS. 12 and 13 are perspective views of the image forming unit with the resin film locally removed along the perforations.
Figure 13:
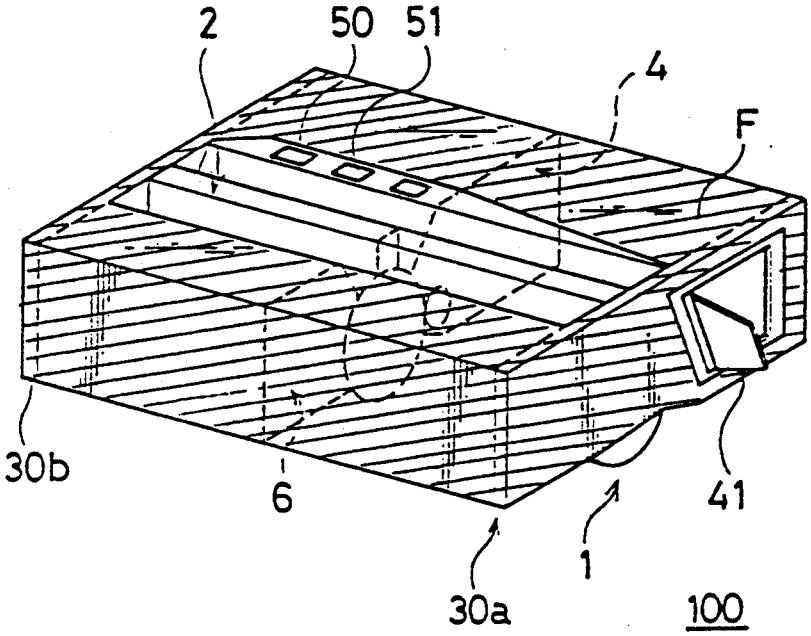

The unit process 100 is used in the manner to be described below with reference to FIGS. 12 and 13 which are perspective views showing the unit 100 with the film portions fl to f4 removed.

Usually, the manufacturer or sales company provides the process unit 100 for the user with the toner filled therein. Accordingly, the manufacturer or the company first opens the perforated portions of the resin film F covering the process unit 100, then fills the toner into the toner compartment 4*b* of the developing device 4 through the replenishing opening 47 and closes the opening 47 with a closure 49.

When the process unit 100 is delivered in this state to the user, the user withdraws the partition 41 to supply the toner from the toner compartment 4*b* to the developing portion 4*a*, then installs the unit 100 in the printer body P and initiates the printer into operation. With the start of printing operation, torque is transmitted from a drive gear 1*c* (shown in FIG. 1) in the printer body P to the gear 1*a* of the photosensitive drum 1, whereby the drum 1, the sleeve roller 44 and the toner agitating impeller 45 are rotated. The drum 1 is irradiated with the laser beam from the optical system 3 and with the eraser light from the eraser lamp 7. Voltage is applied to the sensitizing charger 2 and the sleeve roller 44 from the printer body P via the connectors 50 and 51.

When the developing device 4 of the unit 100 has been emptied of the toner, the unit 100 is removed from the printer body P and delivered from the user to the manufacturer or sales company. The process unit 100 thus collected is replenished with the toner through the replenishing opening 47 for reuse. At the time of toner replenishment, the components which have served for life are replaced. More specifically, the life of the components of the present embodiment, i.e., the process unit 100, is determined as follows. The drum 1 and the blade 61 of the cleaner 6 are replaced every time the toner is replenished. The sleeve roller 44 and the regulating plates 46 are replaced every two replenishments of toner. The sensitizing charger 2 and the toner agitating impeller 45 are replaced every three toner replenishments. The process unit 100 is discarded and replaced by a new unit 100 when the toner is to be replenished the sixth time. The number of times the unit 100 has been replenished with the toner can be recoginzed with reference to the numerals (1) to (5) marked on the side plate 30*a*. More specifically, one of the numerals is smeared away as by a marking pen every time toner replenishment has been made, first from (1) in the order of increasing number. The numerals thus smeared away indicate the number of times the toner replenishment has been made. For example, if the numerals (1) and (2) on the unit 100 removed from the printer body P have been smeared away, this indicates the toner replenishment to be made is the third time, and the drum 1, the blade 61 of the cleaner 6, the charger 2 and the toner agitating impeller 45 are to be replaced at the time of replenishment. If all the numerals (1) to (5) have been smeared away, this indicates that the whole unit is to be replaced when the toner replenishment is to be made the sixth time. The method of determining whether the component of the unit 100 has run down is not limited to the above method wherein the frequency of toner replenishments is referred to for the determination. For example, the process unit 100 may be provided with EPROM for accurate-lay recording the amount each component has been used so as to detect the life of the component with reference to the record.

When some components of the process unit 100 are to be replaced, the resin film F is removed first, and the side plates 30*a*, 30*b* are then removed to separate the unit 100 into the components. The components which have served for life are replaced by new ones, and the components including the new ones, and the side plates 30*a*, 30*b* are assembled into a unit, which is then covered with a resin film F. The film is perforated at the required portions, and openings are formed to obtain a refreshed process unit 100. Through such refreshing procedures, components of the process unit 100 can be reused repeatedly.

Although the image forming unit embodying the invention and described above is adapted for use in a laser beam printer, the invention is applicable also to other image forming apparatus such as copying machines, facsimile systems and microfilm reader-pinters.

Figure 14:
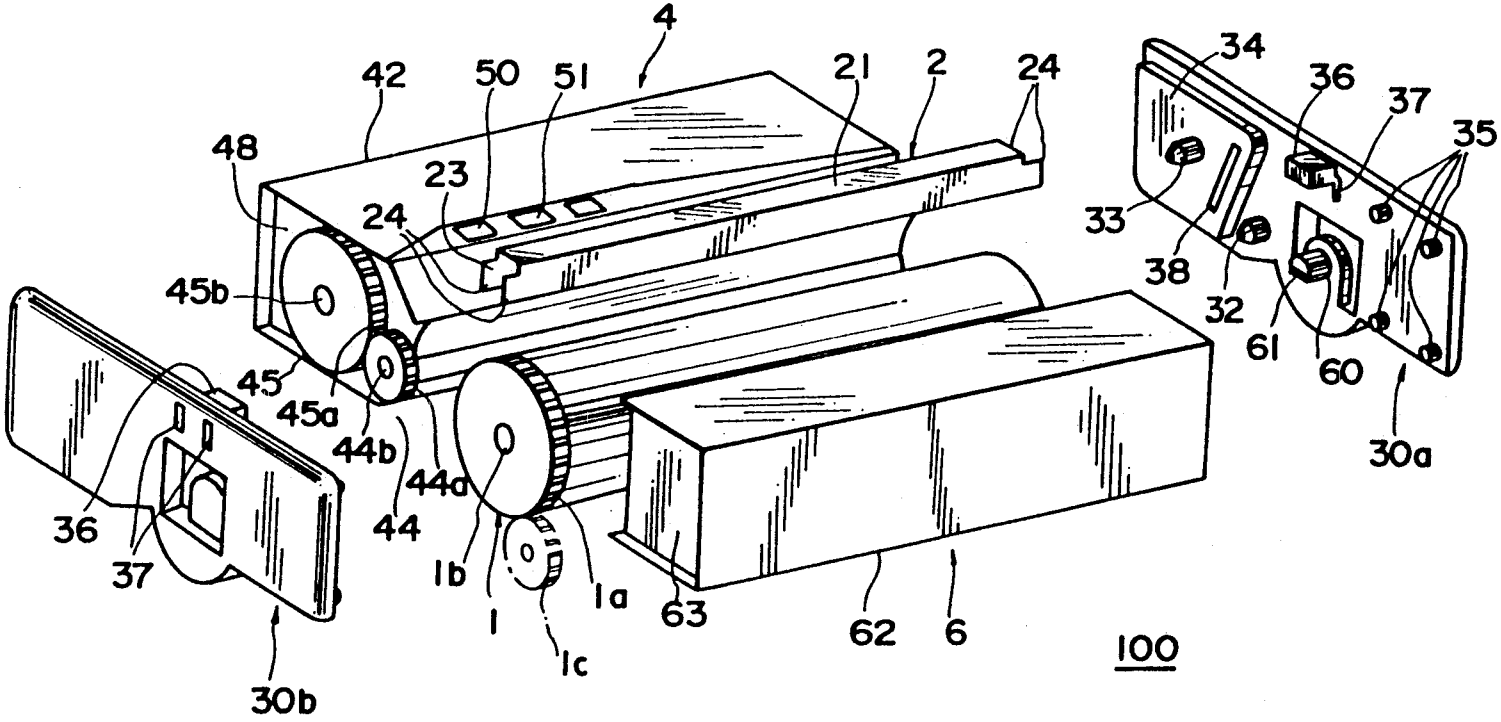
FIG. 14 is an exploded perspective view of another image forming unit embodying the invention.

According to the embodiment described above, the image forming unit is covered with the resin film after the photosensitive drum has been attached to the side plates, whereas the drum may alternatvely be attached to the image forming unit after the unit has been covered with the resin film so as to obviate the influence of heat on the drum. More specifically stated with reference to FIG. 14, the portion 60 of each of the side plates 30*a*, 30*b* to be opposed to the photosensitive drum 1 is in the form of an elastic member which has a bearing 61 fittable in the axial cavity 1*b* of the drum 1. When the drum 1 is pushed into the space between the side plates 30*a*, 30*b* from below the image forming unit as covered with a resin film, each bearing 61 is temporarily retracted outward and then engages in the axial cavity lb. In this way, the drum 1 is held between the side plates 30*a*, 30*b*.

Although the image forming unit is covered with the thermally shrinkable resin film according to the embodiment described, the resin film need not always be used, but a liquid resin material may be applied to the unit by spraying or coating to form the covering. The liquid resin material to be used suitably is a solution of acrylic resin in a solvent containing toluene, methylene chloride and hydrocarbon. When opaque or having the same color as the image forming unit, the resin material serves to make less visible the possible flaws on the component or support body. Especially if a resin molding is used as the support body for the image forming unit, the molding is likely to become discolored with light or heat. The opaque resin material, if used, then serves to prevent the support body from discoloration. Further if the resin material covering the image forming unit has a color in match with the color of the toner filled therein, the appearance of the unit readily indicates the toner color. This obviates the likelihood that the user will install in error an image forming unit having a toner color different from the desired color.

According to the embodiment described, the image forming unit is packaged with the resin material by entirely covering the unit with a resin material in the form of a film and thereafter perforating the resin material to form the openings, whereas the unit may be locally covered with the resin material except at the required portions.

Although the image forming unit embodying the invention and described above is a process unit comprising a photosensitive drum, sensitizing charger, developing device and cleaner and provided in the form of an assembly, the unit may comprise the photosensitive drum and at least one of other components such as sensitizing charger, developing device, transfer charger, cleaner and eraser lamp. The support body for these components is not limited to the plates used in the embodiment but can be in the form of a frame or box. Furthermore, the present invention can be embodied as a single developing unit comprising a plurality of components such as a developing roller and charging blade and covered with a resin material.

As will be apparent from the foregoing description, the image forming unit embodying the invention comprises components which are joined together so as to be easily separable and is covered with a resin material over the outer surface, so that the unit can be readily disassembled without causing damage to the components and the support body for the components, permitting effective reuse of components. Further the resin material covering the image forming unit permits the joints between the components and the support body to retain strength while protecting the outer surface of the unit. When toner is accommodated in the image forming unit, the resin covering serves to prevent the toner from spilling through the joints.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming unit removably mountable in an image forming apparatus, said unit comprising:

a plurality of components; and a covering film means for tightly covering and contacting said plurality of components in the form of said unit in order to firmly join and maintain said components together after said unit has been mounted in said image forming apparatus.

2. An image forming unit as claimed in claim 1, wherein one of said plurality of components is a photosensitive drum.

3. An image forming unit as claimed in claim 1, wherein said covering film is made of a resin material.

4. An image forming nit as claimed in claim 3, wherein said resin material is a thermally shrinkable resin film.

5. An image forming unit as claimed in claim 3, wherein said resin material is opaque.

6. An image forming unit as claimed in claim 1 further comprising a support member for fixedly positioning each of said plurality of components, and wherein said covering film tightly covers said plurality of components and said support member in order to firmly join and maintain said components and said support member together after said unit has been mounted in said image forming apparatus.

7. An image forming unit removably mountable in an image forming apparatus, said unit comprising:

a plurality of image forming elements;

a support member for fixedly positioning each said image forming element; and a covering member means for tightly covering and contacting said support member and said image forming elements in order to firmly connect each said image forming element with said support member after said unit has been mounted in said image forming apparatus.

8. An image forming unit as claimed in claim 7, wherein said support member includes a pair of side plates for positioning each said image forming element therebetween.

9. An image forming unit as claimed in claim 7, wherein said covering member is made of a resin material.

10. An image forming unit as claimed in claim 9, wherein said resin material is a thermally shrinkable resin film.

11. An image forming unit as claimed in claim 9, wherein said resin material is opaque.

12. An image forming unit removably mountable in an image forming apparatus, said unit comprising:

a plurality of image forming elements; and a thermally shrinkable resin film means for tightly covering and contacting said image forming elements in order to firmly connect each said image forming element together after said unit has been mounted in said image forming apparatus.

13. An image forming unit as claimed in claim 12, wherein one of said image forming elements is a developing device.

14. An image forming unit as claimed in claim 13, wherein said resin film has the same color as a toner accommodated in said developing device.

15. An image forming unit as claimed in claim 12 further comprising a pair of side plates for positioning each said image forming element therebetween, and wherein said resin film also tightly covers said pair of side plates to firmly connect each said image forming element and said side plates together after said unit has been mounted in said image forming apparatus.

16. An image forming unit as claimed in claim 12, wherein said resin film is opaque.

17. A method for forming an image forming unit assembled by a plurality of components and mountable in an image forming apparatus, said method comprising the following steps of:

fixedly positioning said plurality of components to a support member;

covering the outside of said support member and said plurality of components fixedly positioned thereto with a resin material;

causing said resin material to contact with said support member and said plurality of components in order to firmly join said plurality of components with said support member; and maintaining said plurality of components and said support ;member in said joined state before and after said image forming unit has been mounted in said image forming apparatus.

18. A method as claimed in claim 17 further comprising the step of applying heat and shrinking said resin material covering said support member.

19. A method as claimed in claim 17 further comprising the step of perforating said resin material at portions corresponding to those of the unit which cooperate with the image forming apparatus in forming images so as to be partly openable.

20. A method as claimed in claim 18 further comprising the step of, when said unit includes a photosensitive drum, covering the drum with a heating insulating material before said covering step to render said drum free of an influence of heat.

21. An image forming unit as claimed in claim 1, wherein said covering film is removable for replacement of one or more of said plurality of components.

22. An image forming unit as claimed in claim 7, wherein said covering member is removable for replacement of one or more of said image forming elements.

23. An image forming unit as claimed in claim 12, wherein said image forming elements are separable from each other for replacement of one or more of said image forming elements, after said thermally shrinkable resin film is removed from said image forming unit.

* * * * *